US005201519A

United States Patent [19]

Sorteberg

[11] Patent Number: 5,201,519

[45] Date of Patent: Apr. 13, 1993

[54] CROQUET SET, PARTICULARLY, FOR MINIATURE CROQUET GAME

[76] Inventor: Johannes Sorteberg, 111 Glover Ave., Norwalk, Conn. 06850

[21] Appl. No.: 553,986

[22] Filed: Jul. 17, 1990

[51] Int. Cl.[5] ..... A63B 67/00

[52] U.S. Cl. ..... 273/56

[58] Field of Search ..... 273/56, 32; 296/19.2

[56] References Cited

U.S. PATENT DOCUMENTS

| | | | |
|---|---|---|---|
| 143,047 | 9/1873 | West et al. . | |
| 159,193 | 1/1875 | Logan . | |
| 168,323 | 10/1875 | Crandall . | |
| 612,965 | 10/1898 | Gallup . | |
| 816,758 | 3/1906 | Stichwen | 273/56 |
| 1,623,284 | 4/1927 | Stoddart . | |
| 2,006,497 | 7/1935 | Couse | 273/56 |
| 2,103,428 | 12/1937 | Lutes | 273/56 |
| 2,116,651 | 5/1938 | Ackerson | 273/56 |
| 2,204,482 | 6/1940 | Filipiak | 294/19 |
| 2,256,175 | 9/1941 | Schmidt | 273/41 |
| 2,455,012 | 11/1948 | King | 273/127 |
| 2,551,486 | 5/1951 | Burden | 294/19.1 |
| 2,583,493 | 1/1952 | Prentice | 273/56 |
| 2,657,056 | 10/1953 | Sorteberg | 273/56 |
| 3,084,941 | 4/1963 | Anthony | 273/56 |
| 3,464,697 | 9/1969 | Robillard | 273/56 |
| 3,695,610 | 10/1972 | Thompson | 273/56 |
| 3,773,324 | 11/1973 | Haines, Jr. | 273/123 |
| 3,785,656 | 1/1974 | Gybowski | 273/56 |
| 3,814,430 | 6/1974 | Leumi | 273/129 |
| 4,295,650 | 10/1961 | Keeble | 273/56 |

*Primary Examiner*—Theatrice Brown
*Attorney, Agent, or Firm*—F. Eugene Davis, IV

[57] ABSTRACT

A plurality of wickets are assembled into a unitary structure each wicket having a plurality of marker receiving means. Individually visibly identifiable direction markers are adapted to engage said marker receiving means in two positions so as to indicate passage through a wicket in either of two directions. The home and return stakes are also provided with marker receiving means and a bell at their base adapted to ring when struck by a croquet ball. Means are provided for adjusting the openings through the wickets and for defining a four-sided field at the wicket assembly. The wickets are recessed to receive a mallet head which fits end to end in said recess to define passage of a ball through the wicket. A ball retainer has an elongated axis and spaced members adapted to confine a ball to permit it to be struck by a croquet mallet when croqueting a ball and means operated by its handle to cause the space members to confine a ball and permit the ball to be lifted from the playing surface.

20 Claims, 14 Drawing Sheets

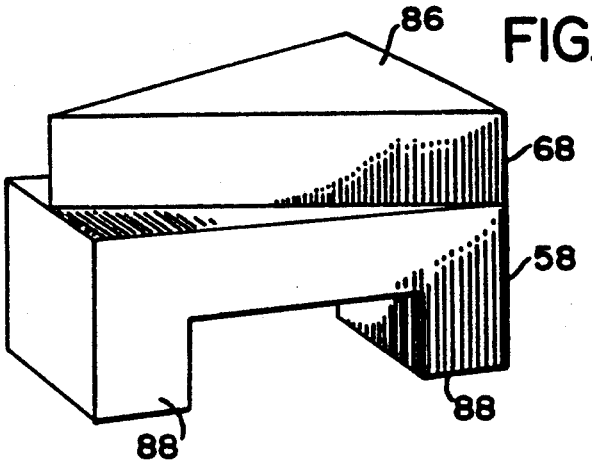
FIG. 13
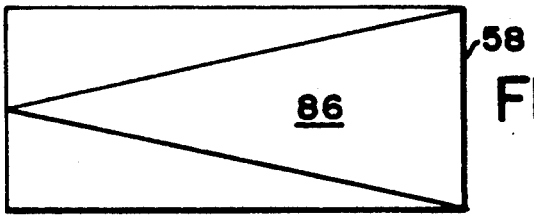
FIG. 14
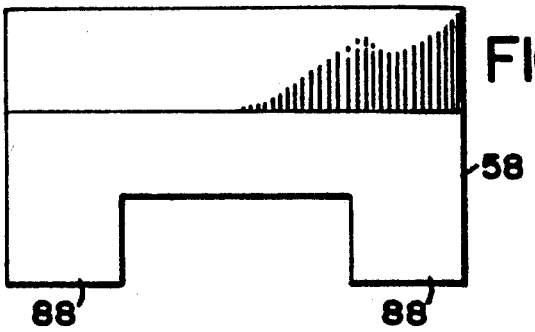
FIG. 15
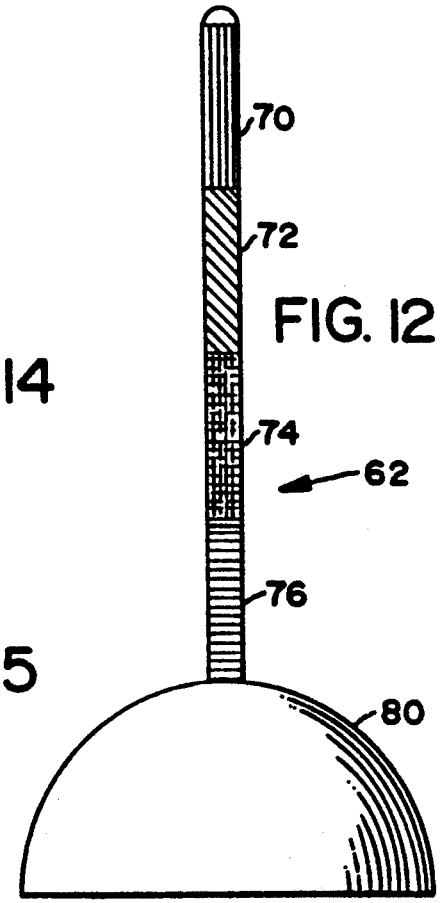
FIG. 12
FIG. 16
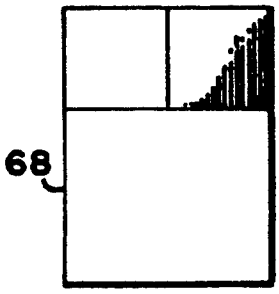
FIG. 17
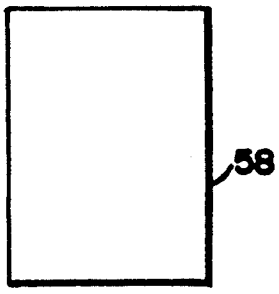

100
100

102
50

92'

92'
40'
94'
96'
98
99

58

58

58

62
82
84

80
84

CROQUET SET, PARTICULARLY, FOR MINIATURE CROQUET GAME

SUMMARY OF THE INVENTION

This invention relates to croquet sets, more particularly to such, for use in a miniature croquet game adapted to be played on a rug or a carpet. The set is an improvement on my earlier croquet set disclosed in my earlier U.S. Pat. No. 2,657,056, Issued: Oct. 27, 1953 for BALL CONFINING CLUB FOR CROQUET. I have made a number of improvements in the croquet set to facilitate its indoor use. Some of the improvements I have made include a ball retainer for retaining a ball when it is used to croquet another ball. The ball retainer is provided with cam means operated by the handle for spreading apart the ball confining legs such that the ball may be surrounded, the legs closed, and ball picked up by the ball retainer.

I provide a wicket assembly which may be die cast having direction marker receiving means on each wicket and a plurality of direction markers visually coded to indicate a players next wicket and the direction in which his ball must go through said wicket All members of the assembly are tapered to facilitate use of the die casting technique. At least one of the wickets, and preferably all of the wickets, have a recess therein for receiving a croquet mallet head end to end such as to define passage of a ball through the wicket. I provide color coded stakes which comprise a bell at the bottom which rings when struck by a ball, and color coded marker receiving means, four field markers, and balls, mallets, and ball retainers which are all correspondingly color coded to each ball and to each ball's signal marker. I provide means for changing the size of the opening in the wickets to change the difficulty of the game.

The invention accordingly comprises the features of construction, combinations of elements, and arrangements of parts which will be exemplified in the constructions hereinafter set forth. The scope of the invention will be indicated in the claims.

BRIEF DESCRIPTION OF THE DRAWINGS

For a fuller understanding of the nature and objects of the invention, reference should be had to the following detailed description, taken in connection with the accompanying drawings, in which:

FIG. 12 is a front view of the end stake of FIG. 8 with the wicket passage indicator receiving means removed;

FIG. 13 is a perspective view of a wicket passage indicator shown in FIG. 1;

FIG. 14 is a top view of the wicket passage indicator of FIG. 13;

FIG. 15 is a side view of the wicket passage indicator of FIG. 13;

FIG. 16 is a front view of the wicket passage indicator of FIG. 13;

FIG. 17 is a back view of the wicket passage indicator of FIG. 13;

FIG. 28A is a partial bottom view thereof;

FIG. 28B is a partial top view thereof;

The same reference characters refer to the same elements throughout the several views of the drawing.

DETAILED DESCRIPTION OF THE INVENTION

Figure 1:
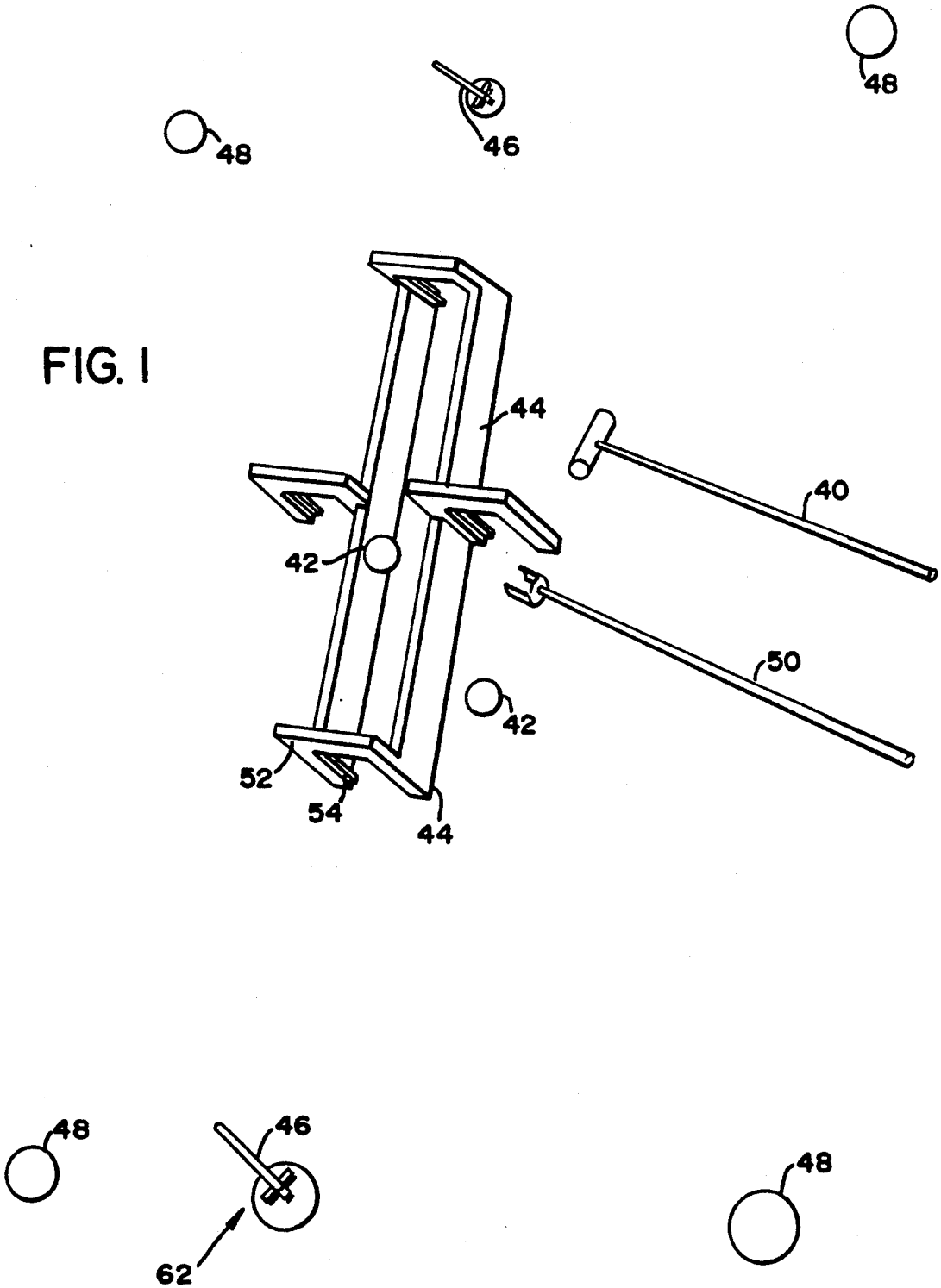
FIG. 1 is a perspective view of the basic elements of a croquet set according to my invention.

A croquet set according to my invention, particularly, for playing a miniature croquet game on a carpet or rug is shown in FIG. 1. It comprises one or more mallets (40), one or more balls (42), a wicket assembly (44), end stakes (46), and four-corner field markers (48); and a special ball retainer (50).

Figure 2:
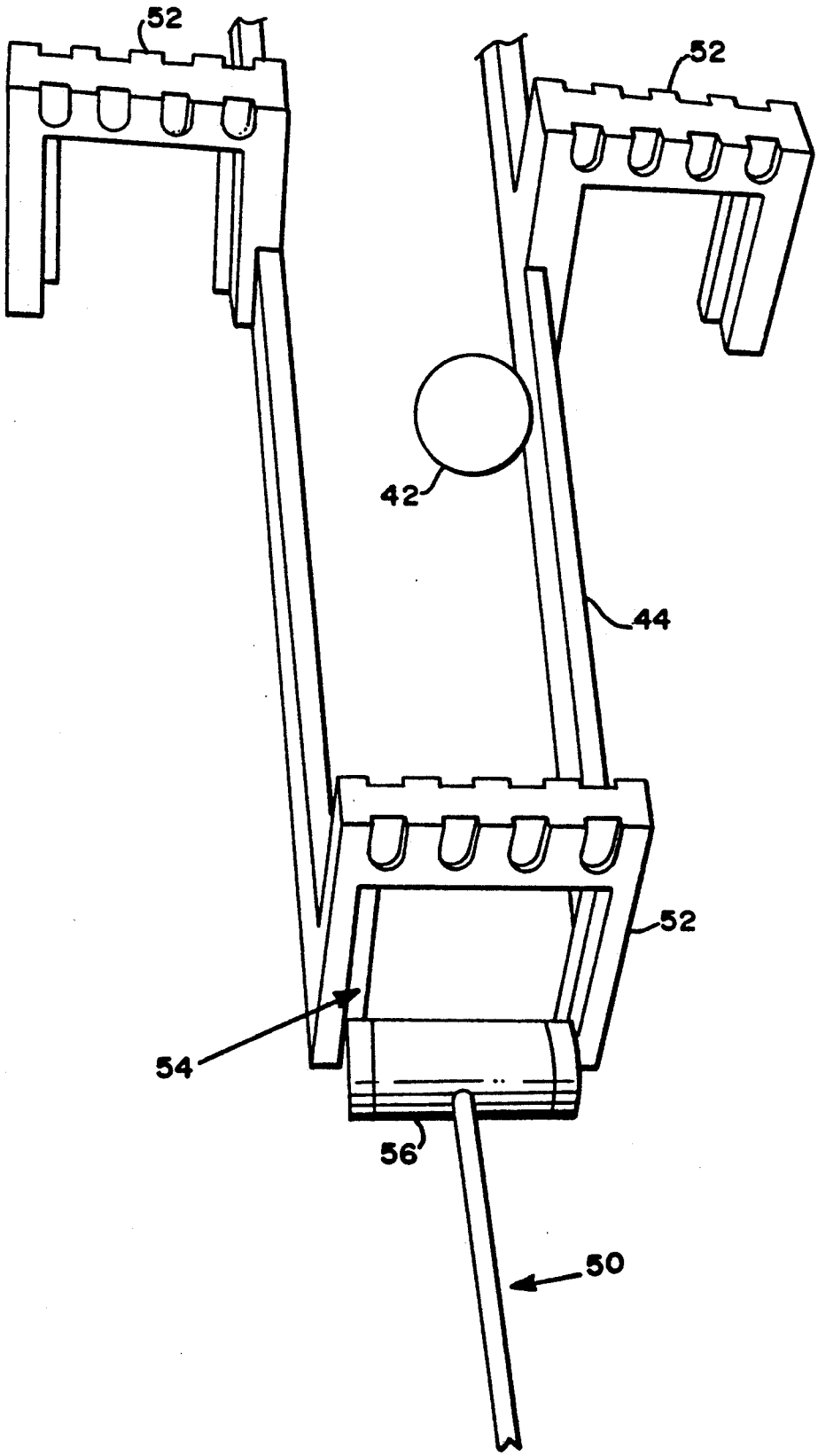
FIG. 2 is an enlarged perspective view of one end of the wicket assembly of FIG. 1 together with a mallet according to my invention.

Now referring to FIG. 2, each wicket (52) of the wicket assembly (44) may be provided with a recess portion, generally indicated, at (54) which is just large enough to allow mallet head (56) to fit therein. This is used to define passage of a ball through the wicket. Passage is defined as when the mallet head (56) may be fitted in and brought up and down in recess (54) and not touch a ball (42) which may not be completely through the wicket (52). Such recesses (54) may, according to my invention, be provided at both sides of the wickets (52).

Figure 3:
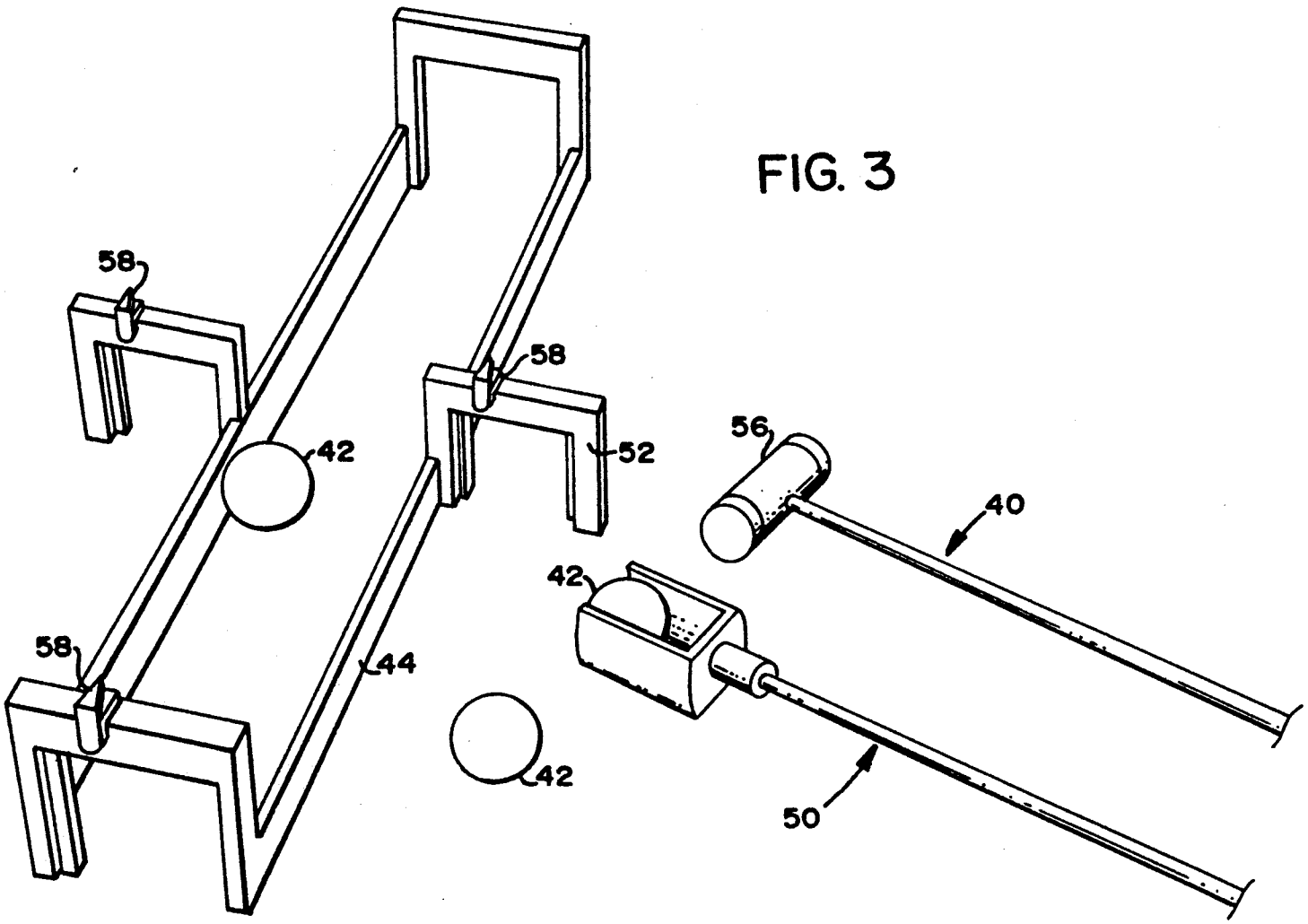
FIG. 3 is an enlarged perspective view showing the wicket assembly balls, mallets, and ball retainer according to my invention.

FIG. 3 is an enlarged view of a portion of the set shown in FIG. 1 showing wicket passage indicators (58) which may be fitted into a plurality of retainers (60) on top of each wicket. Thus, for a four ball game, four retainers (60) would be provided on each wicket and four different colored indicators provided corresponding to four different colored mallets (40), four different colored balls (42), four different colored ball retainers (50). Each of the stakes (46) are correspondingly stripped and provided with indicator retainers (62).

Figure 4:
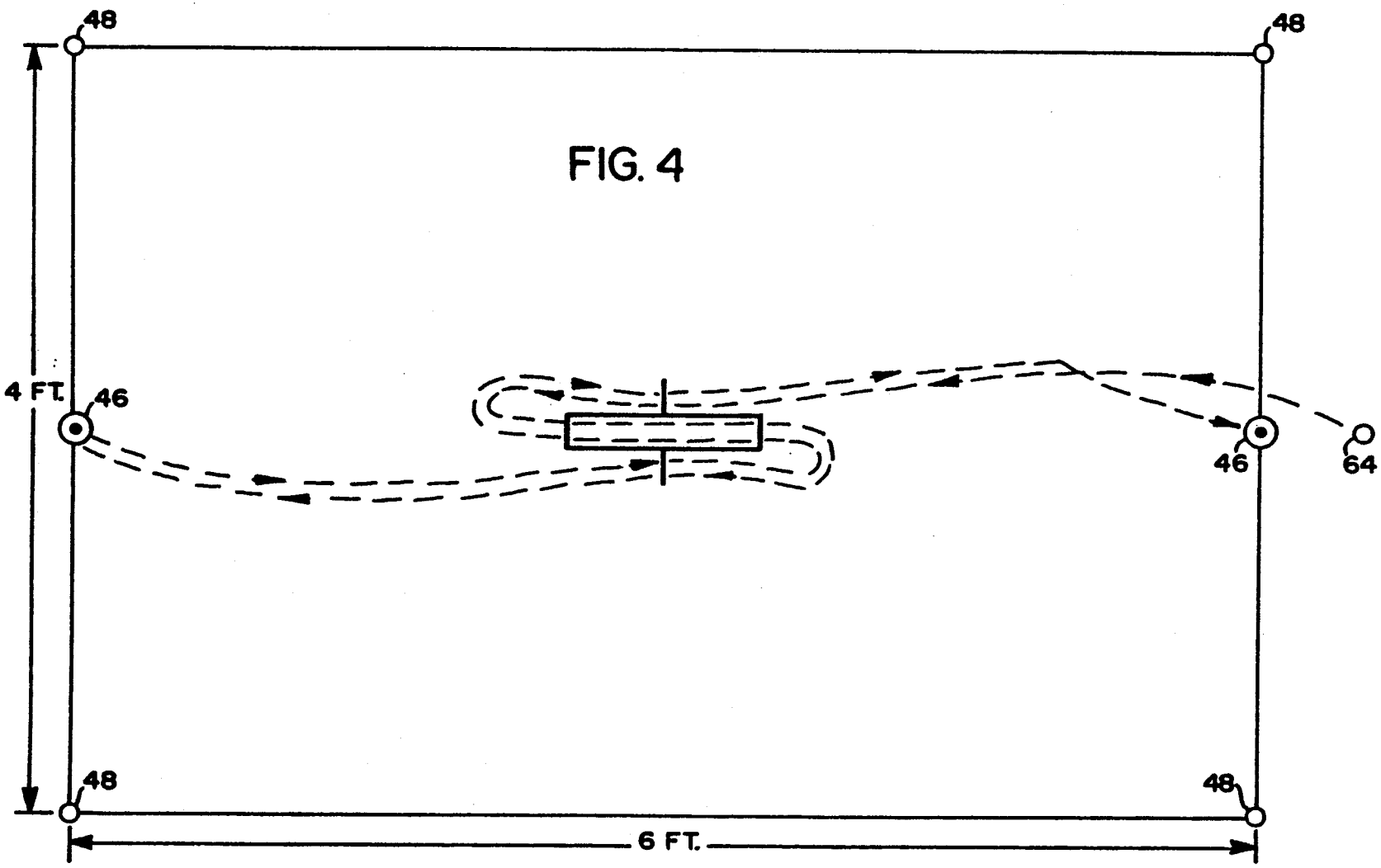
FIG. 4 is a diagram of a croquet game according to my invention.

A game according to the invention may be played as indicated in FIG. 4. The four field markers (48) are laid out to form a rectangle, the home stake (46) placed at the right, and an identical return stake (46) placed at the left. A player then starts his ball at a starting point (64) nine inches behind the home stake and must drive his ball following the dotted line as shown by the arrows through the wicket assembly to the return stake and then back through the wicket assembly in the opposite direction.

A preferred game according to the invention is a partnership game for 2, 3, or 4 participants and is always played with four (4) balls identified with four different colors, for instance, red, green, yellow, or blue played in that sequence — red and yellow are partners and green and blue are the other partners. With two (2) participants, each plays two balls and with three participants only one plays two balls. The balls and wickets are scaled down to make the game approximately the same degree of difficulty as for that of a game of lawn croquet. The four balls are one inch diameter and four wickets are embodied in a cluster with four passages (the wickets) adjustable from 1½' to 1⅛' in width. In addition, there are two stakes mounted on bells which signal hits, four directional markers, and four boundary markers.

An ideal field would be a 9'×12' carpet with an open space allowing a 4'×6' playing area. The course arrangement is shown in FIG. 4.

RULES

Each ball starts as shown in FIG. 4 about 9" straight behind the home stake. How all players eventually get into the game is easiest learned by first selecting partners, next drop the four balls at random within the playing area, put the four direction markers at random in four locations on the wicket structure and let for instance, you as red, You have the following five options:

1. You may leave your ball in place and take no further action, or

2. You may try to negotiate your due wicket (or stake) after first having moved your marker to the next due wicket (or stake) and if successful you are back to your five options again.

3. You may try to hit one of the other balls and if successful place your ball one mallet head away from it and take no further action. This is called making a setup, and is frequently done if the ball you hit was your partners ball, or 4. You may take your ball to the ball you hit and croquet it away and take no further action, or 5. Take one more stroke which may be aimed at one of the other balls and if successful in hitting it you have options 1, 2, 3, 4, & 5 all over again, but you may not hit any ball *twice* before you negotiate your due wicket or stake after which your options one through five start all over again.

NOTE 1. A ball must always be *hit* not *pushed* or hit by the side of the mallet.

NOTE 2. You have negotiated a wicket when you can move your mallet head up and down in the recess in the entering side of the wicket without touching your ball.

NOTE 3. When a ball has negotiated its next destination its marker must be moved to its new destination at the end of your turn. *Where you leave the marker is your next destination.*

NOTE 4. If a ball stops outside the playing area it must be moved back immediately in the direction of the cluster and be put on the border line.

NOTE 5. You may not 'drive' two balls that are so close that the two balls will travel in unison. You may touch the other ball and croquet it, or make a setup, or hit the other ball intentionally in such a direction that the two balls will take obviously different paths.

NOTE 6. If a ball passes through its wicket of destination or hits the home stake, it counts as if you played it yourself.

NOTE 7. Once a ball has hit the home stake as its immediate destination, it is out of action. This is very important as one partnership will have two turns for the others' one from then on until there are only two balls left.

NOTE 8. You may not hit the wicket cluster or any of the other stationary objects with your mallet.

Of course, any other croquet rules or games may be played with the set according to my invention.

NOTE 9. When a player causes a partner's or opponent's ball to pass outside the playing field, it is the duty of that player to bring it back to the border line from the location it stopped in the direction of the center wicket immediately after he is through with his playing cycle.

Figure 5:
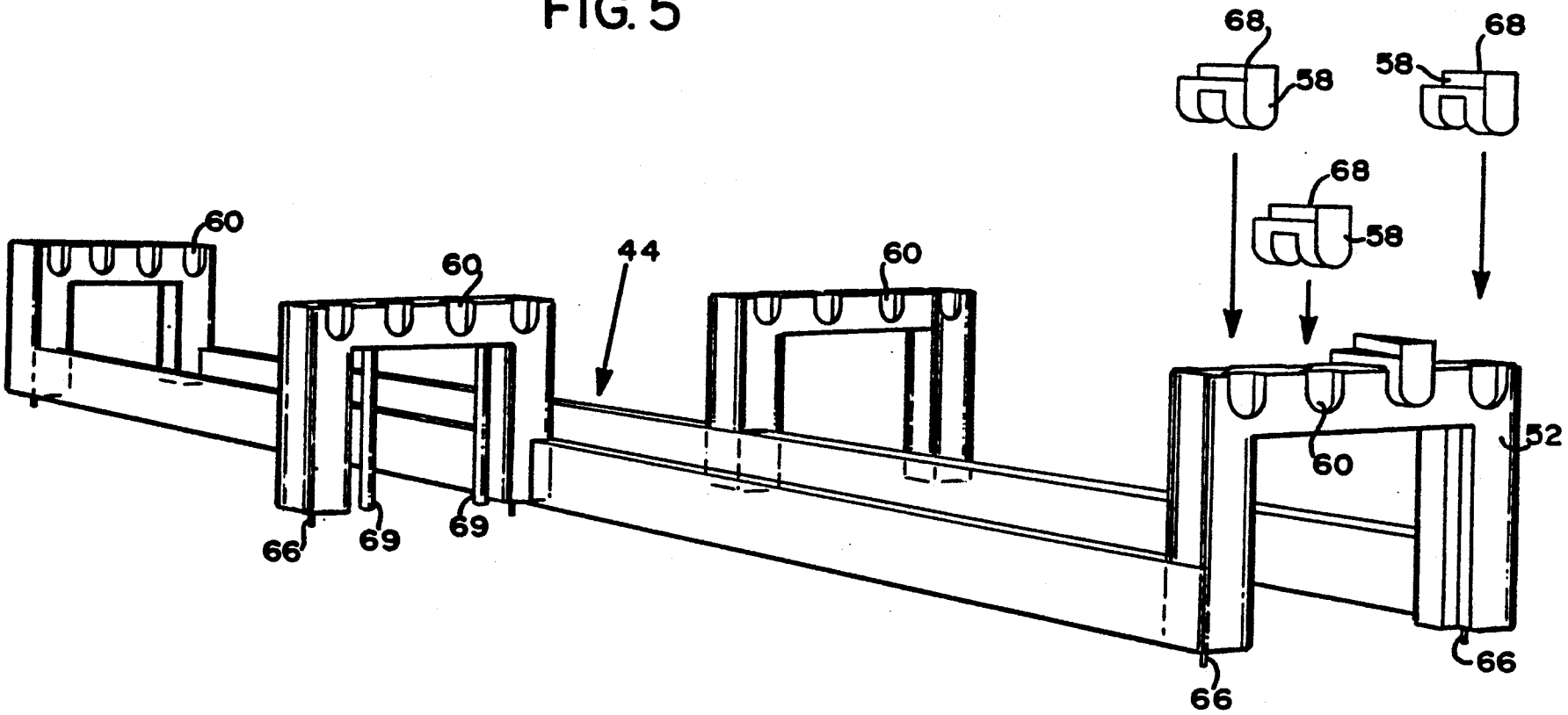
FIG. 5 is a perspective view of a wicket assembly according to my invention.
Figure 6:
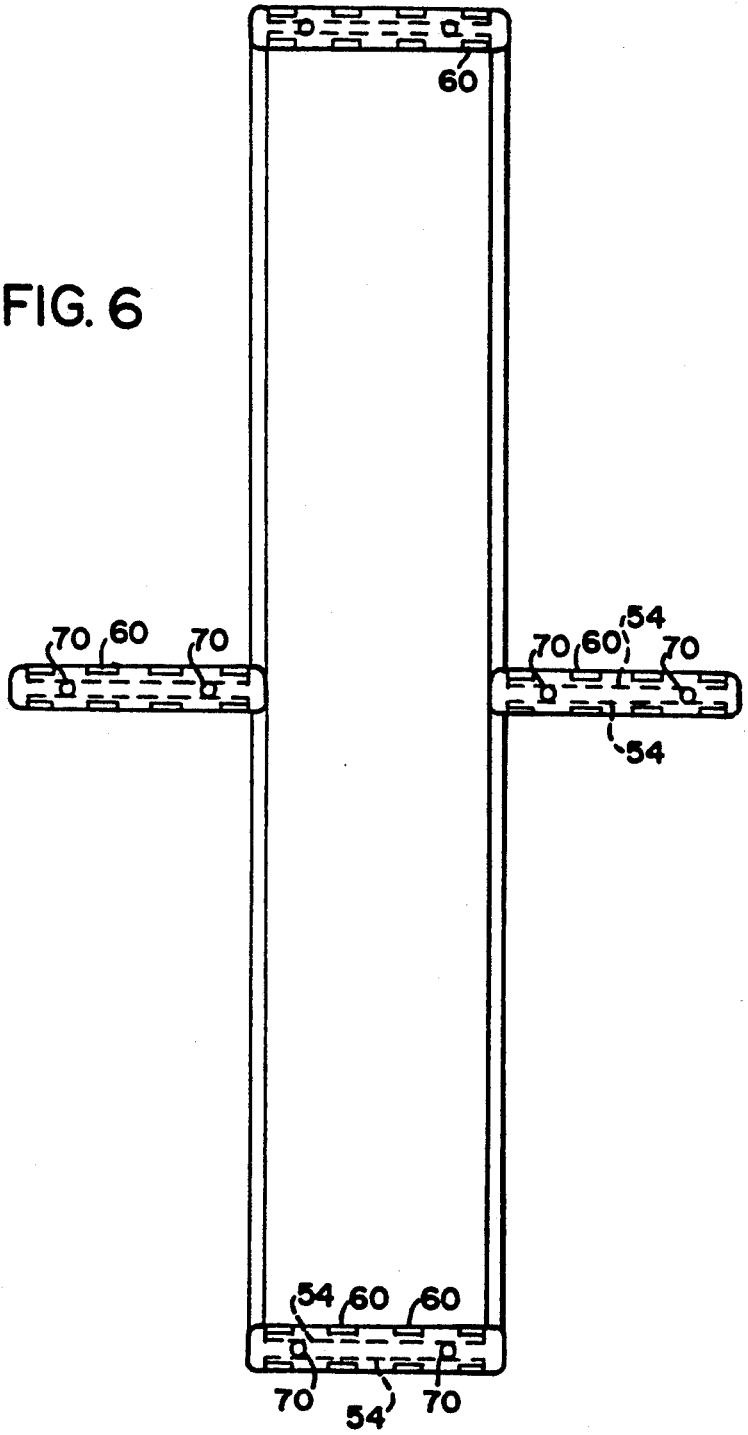
FIG. 6 is a top view of a wicket assembly according to my invention.
Figure 7:
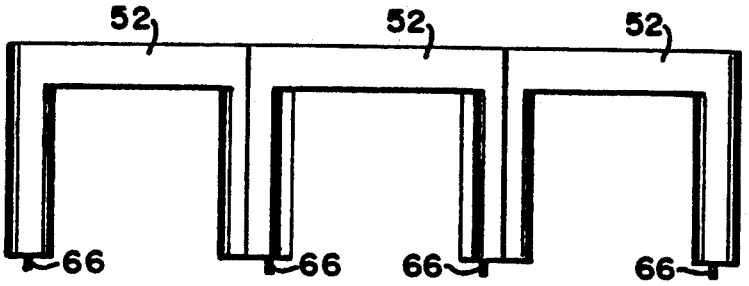
FIG. 7 is an end view of the wicket assembly of FIGURE 5.

The wicket assembly (44) shown in FIG. 5 is preferably formed of die cast aluminium and preferably provided with a plurality of depending needle-like pins (66) for engaging the carpet or rug. The wicket passage signals (58) may also be formed of die cast aluminium or of plastic or of any other convenient material. They are color coded the same as the balls, the mallets, and the ball retainers, preferably, but may be coded in other ways such as with symbols. They are always placed so that their arrow portion (68) points in the direction the corresponding ball must go through on the next wicket (52) through which it must go. In FIG. 6 it is shown how each wicket (52) may be provided with recesses (54) on each side to accept a mallet head (56) as shown in FIG. 2.

I provide pins (69) which may be put in holes (71) (FIG. 6) of each wicket to narrow the passageway and thus increase the difficulty of the game.

Figure 9:
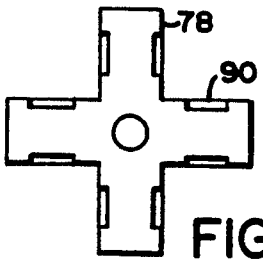
FIG. 9 is a top view of the end stake indicator holder of FIG. 8.
Figure 8:
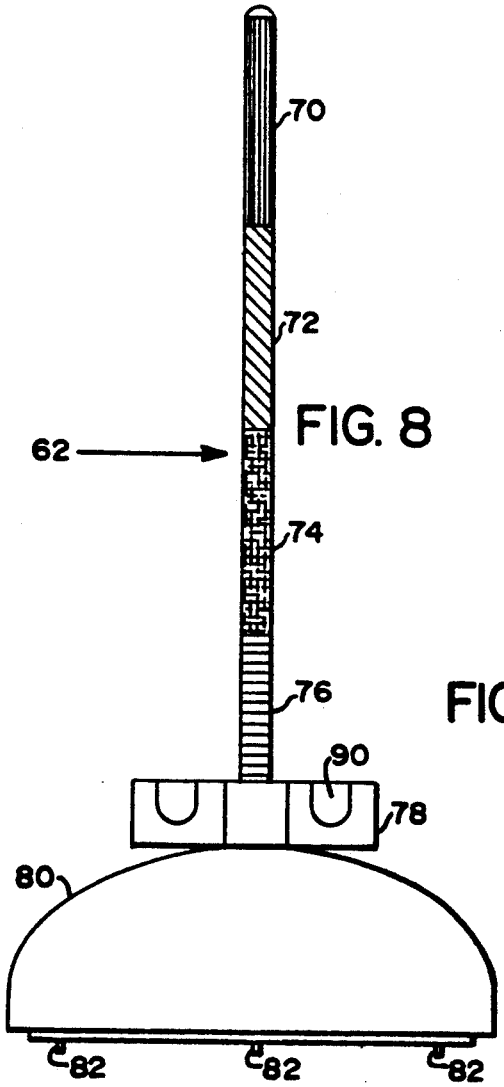
FIG. 8 is an enlarged front view of an end stake shown in FIG. 1.
Figure 10:
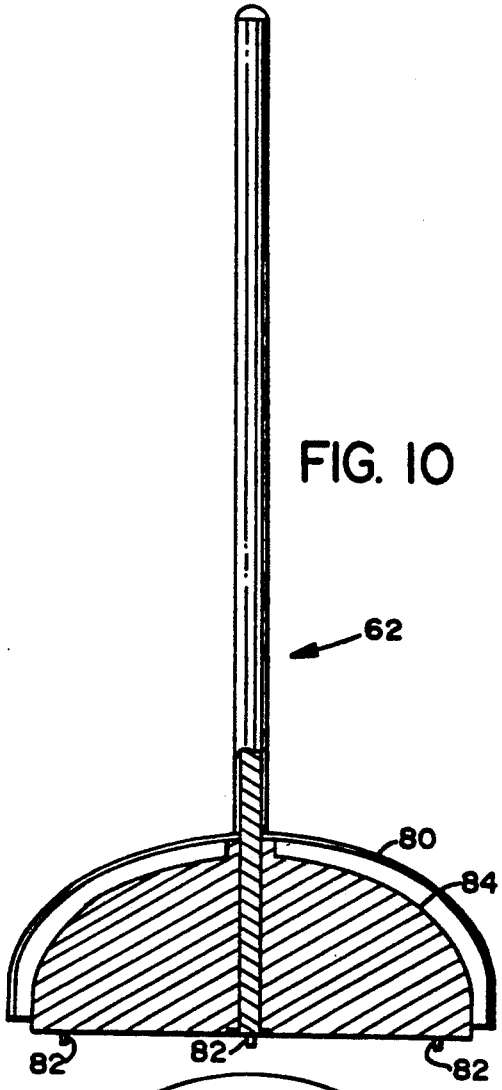
FIG. 10 is a front view, partially, in cross section of the end stake of FIG. 8.
Figure 11:
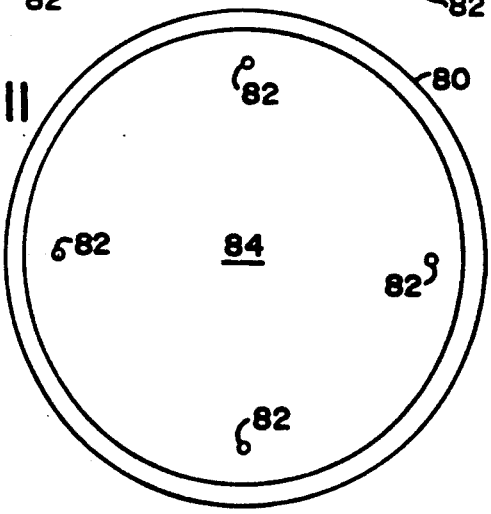
FIG. 11 is a bottom view of the end stake of FIG. 8.

Now referring to FIGS. 8 through 12, each end stake (62) is preferably provided with four color coded portions (70, 72, 74, and 76) a wicket passage indicator receiver (78) shown in top view in FIG. 9, a metal bell (80) which rings when struck by a croquet ball, and a plurality of needle-like pins (82) for engaging the rug or carpet. Alternatively, as shown in FIG. 12 the ringing bell (80) wicket passage indicators holder (78) and pins (82) may be dispensed with — reliance being put on a heavy weight (84) to hold the stake steady.

Now referring to FIGS. 13 through 17, each indicator (58) is provided with an upper arrow-like portion (68) preferably color coded or otherwise coded to match the balls, mallets, and ball retainers on its top portion (86). Each is provided with a pair of leg portions (88) which preferably may be round as shown in FIG. 5 to fit into rounded recesses (60) in each wicket (52) or may be square as shown in FIGS. 13 through 17 or any other convenient shape. They are also adapted to fit into the recesses (90) of the indicator retainer (78) shown in FIGS. 8 and 9.

Figure 18:
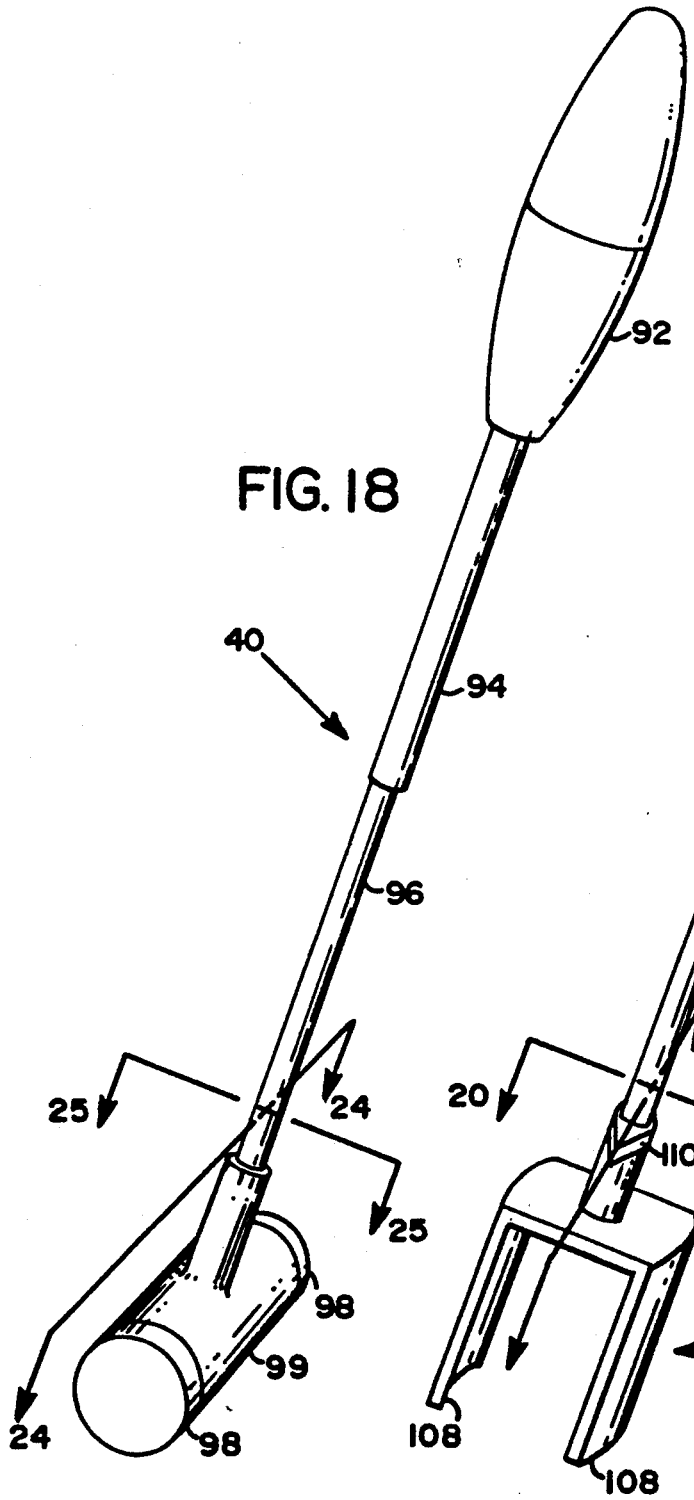
FIG. 18 is a perspective view of the mallet of FIG. 1.

Referring to FIG. 18, each mallet (40) is provided with a handle (92) which may be plastic or wood, for example; and a two-piece telescoping shaft having a top portion (94) and a bottom portion (96). It is possible to have more than two pieces in the shaft portions (94, 96) which are adapted to operate in the manner of a radio antenna or collapsible pointer. The mallet is preferably provided with metal inserts (98) to give it weight and a good feel. The handle (92) is color coded as is the head portion (99).

Figure 19:
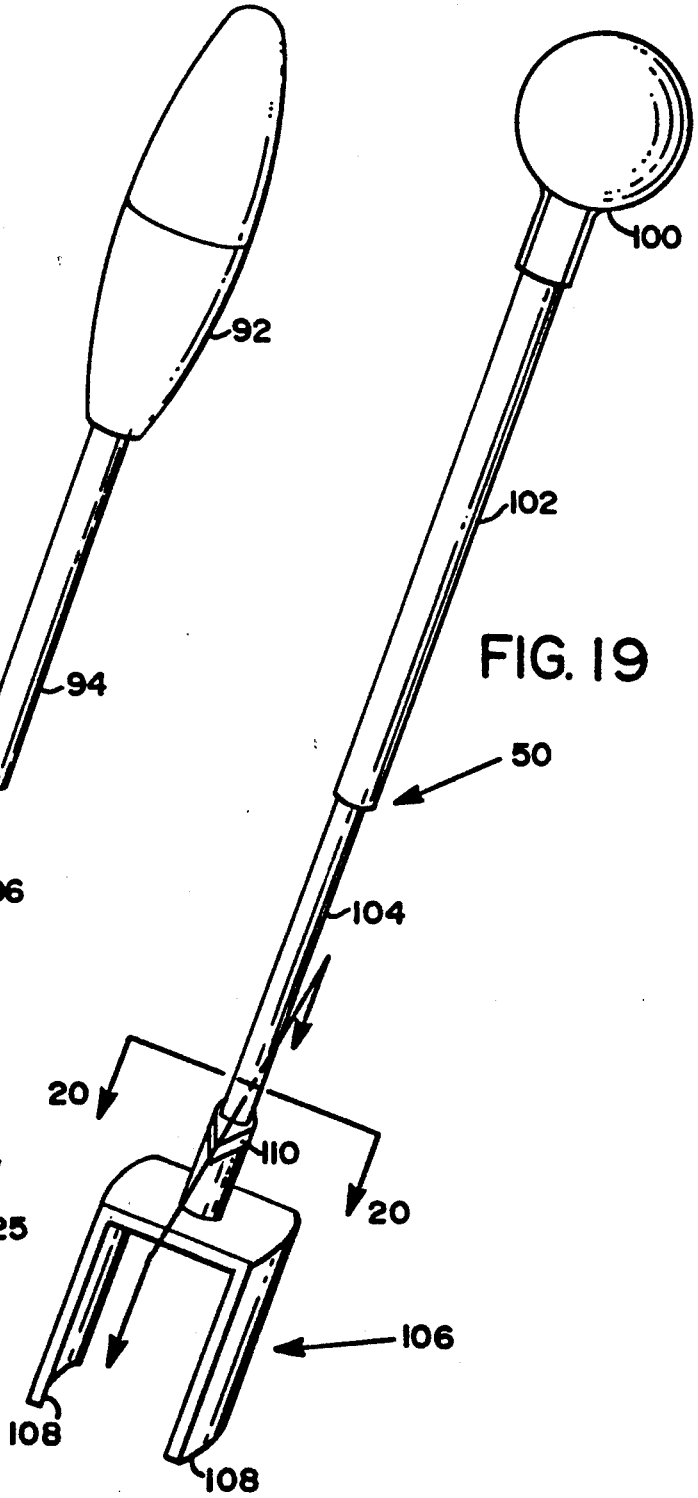
FIG. 19 is perspective view of the ball retainer of FIG. 1.

The ball retainer (50) shown in FIG. 19 is also provided with a color coded handle (100) which may be plastic or wood and telescoping shaft pieces (102) and (104). The color coded head portion, generally indicated at (106) which may be plastic is provided with a pair of curved legs (108) which are adapted to surround a croquet ball. Rotation of the handle (100) rotates the shaft pieces (102) and (104) and a cam (111) (FIGS. 20 through 23) which spreads legs (108) apart. Whether the legs are spread apart or not, is indicated by indicator (110) mounted on shaft portion (104). The legs (108) are provided with rug engaging pins (109).

Operation of the ball retainer (50) is best seen in FIGS. 20, 21, 22, and 23. When the handle (100) is turned, the cam, which is oval shaped, pushes against cam followers (112) and spreads legs (108) apart so that a ball (42) loosely fits therein. When the handle (100) is rotated another 90°, the cam (110) allows the legs (108) to close to frictionally hold the ball (42) so that it may be lifted from the playing field and moved over against another player's ball when the other player's ball is to be croqueted.

Figure 20:
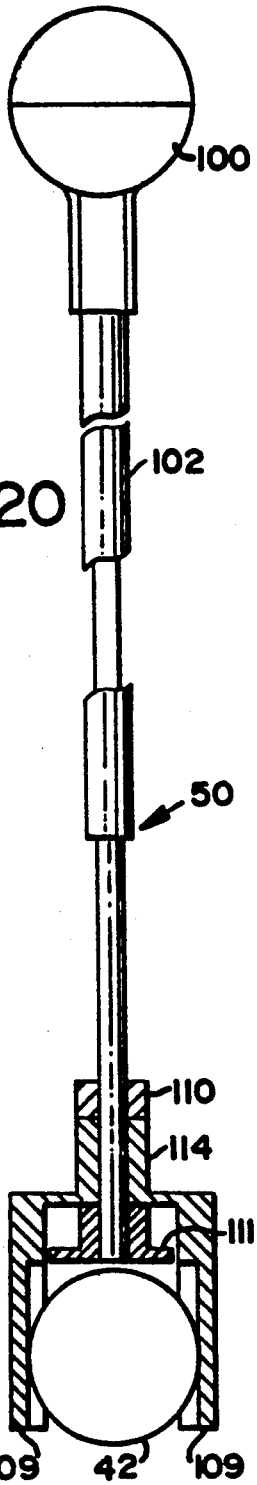
FIG. 20 is a front view, partially in cross section, and partially cut away, of the ball retainer of FIG. 19.
Figure 22:
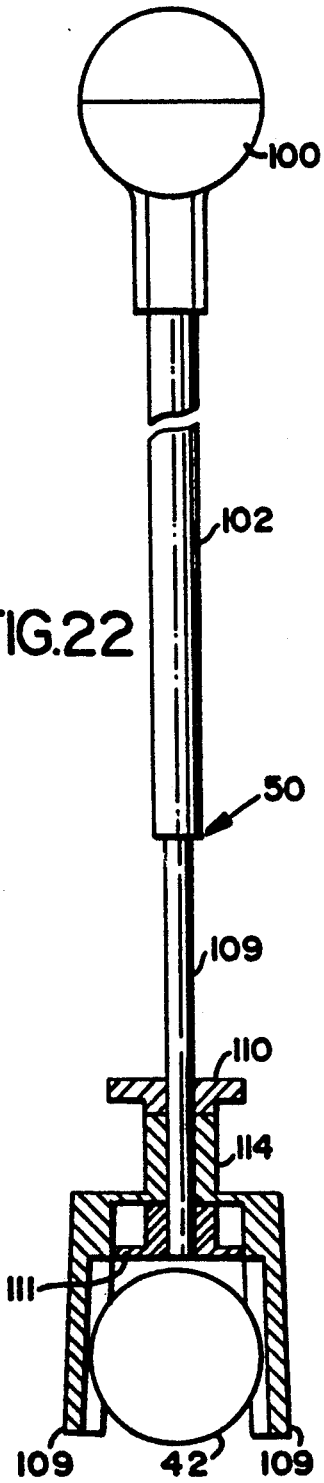
FIG. 22 is a front view, partially in cross section, of the ball retainer of FIG. 19.
Figure 21:
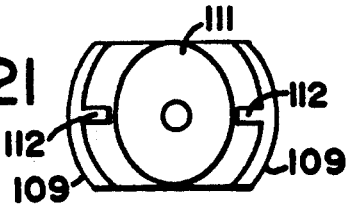
FIG. 21 is a bottom view of the ball retainer of FIG. 20.
Figure 23:
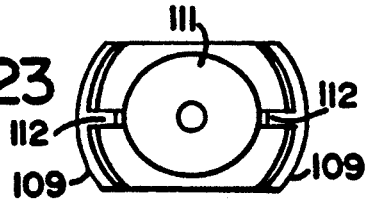
FIG. 23 is a bottom view of the ball retainer of FIG. 20.
Figure 24:
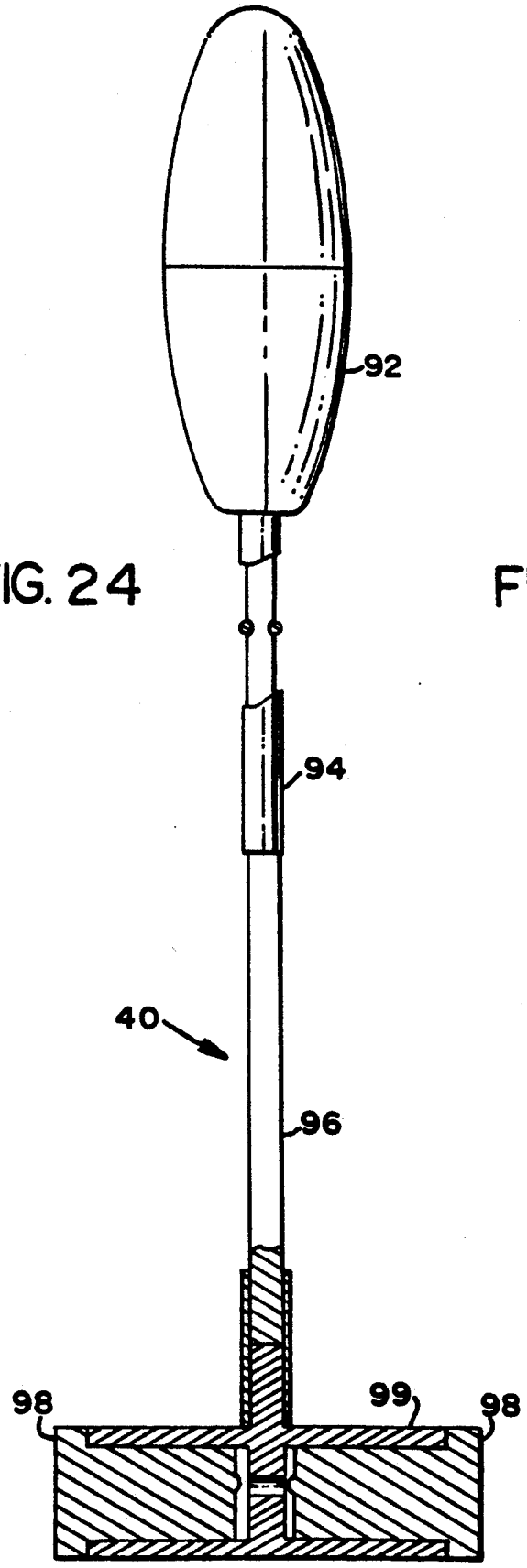
FIG. 24 is a partial cross sectional view of the croquet mallet of FIG. 18.
Figure 25:
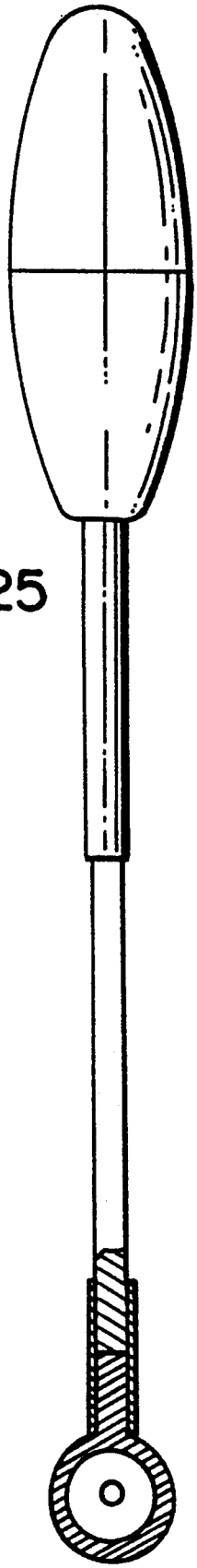
FIG. 25 is a side view, partially in cross section, of the mallet of FIG. 18.
Figure 26:
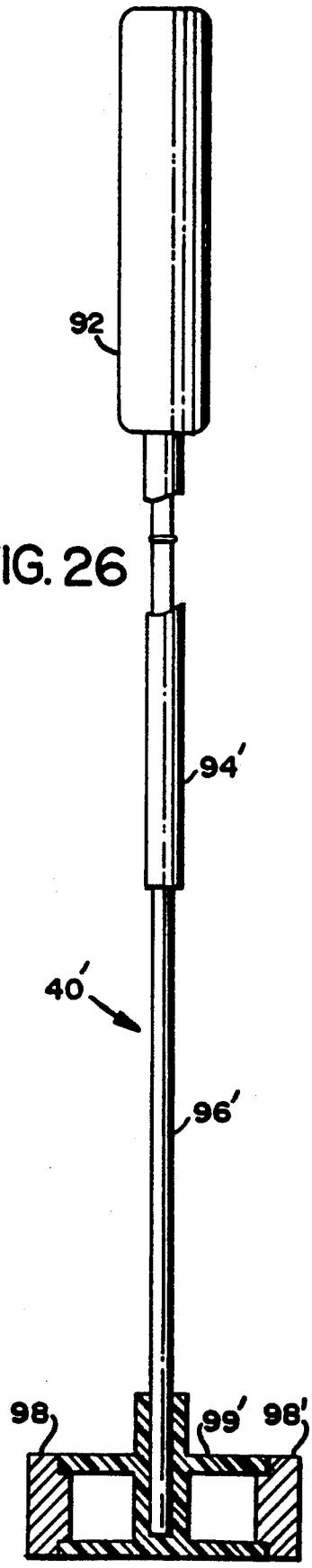
FIG. 26 is a partial cross sectional front view of an alternative croquet mallet according to my invention.
Figure 27:
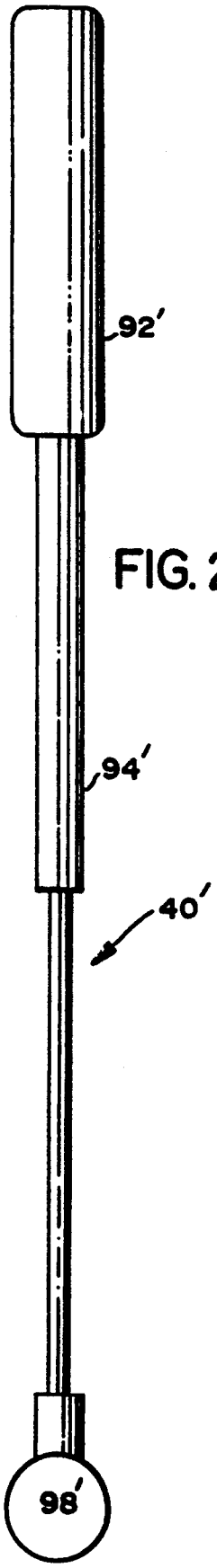
FIG. 27 is a side view thereof.

The ball retainer (50) is required since the balls are too small to be placed under the foot, as a normal croquet ball, when croqueting another player's ball. The improvement I have provided here over the ball retainer shown in my earlier patent, is to open and close the legs (108) by rotation of the handle or any other convenient operation of the handle to allow the ball retainer to be placed over a ball and then to engage the ball and lift it from the playing field and place it next to the other player's ball to be croqueted. In FIGS. 20 and 22, it can be seen how the indicator (110) which is press fitted on shaft portion (104) as is cam (111), rotates with cam (111) — shoulder portion (114) of ball retainer (50) being loosely fitting about shaft (104).

FIGS. 24, 25, 26, and 27 illustrate how different size weights (98) and (98') may be used as well as different shaped handles (92) and (92') for the mallets (40).

Figure 28:
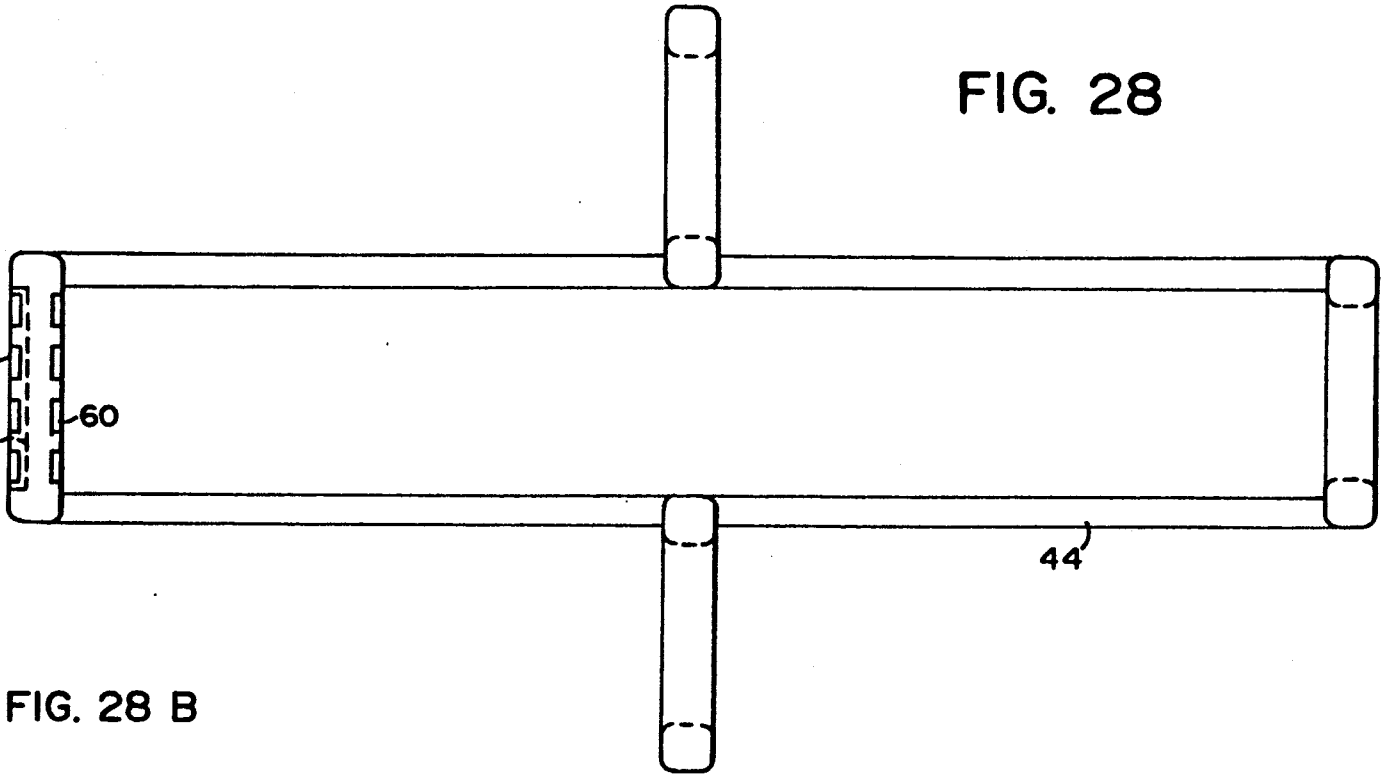
FIG. 28 is a top view of the wicket cluster of FIG. 1.
Figure 28A:
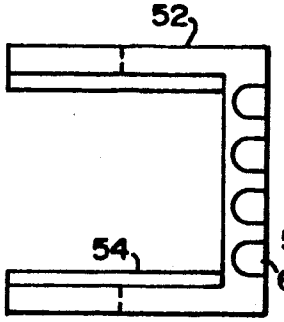
FIG. 28A is a partial end view thereof.
Figure 28B:
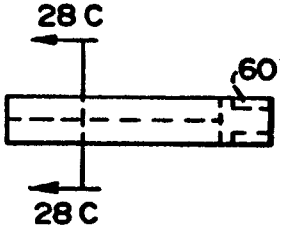
FIG. 28B is a partial side view thereof.
Figure 28C:
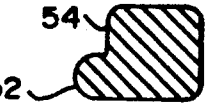
FIG. 28C is a cross-sectional view then along the line C—C in FIG. 28B.
Figures 29, 29A, 29B, 30, 30A, 30B, 31, 31A, 32, 32A, 32B:
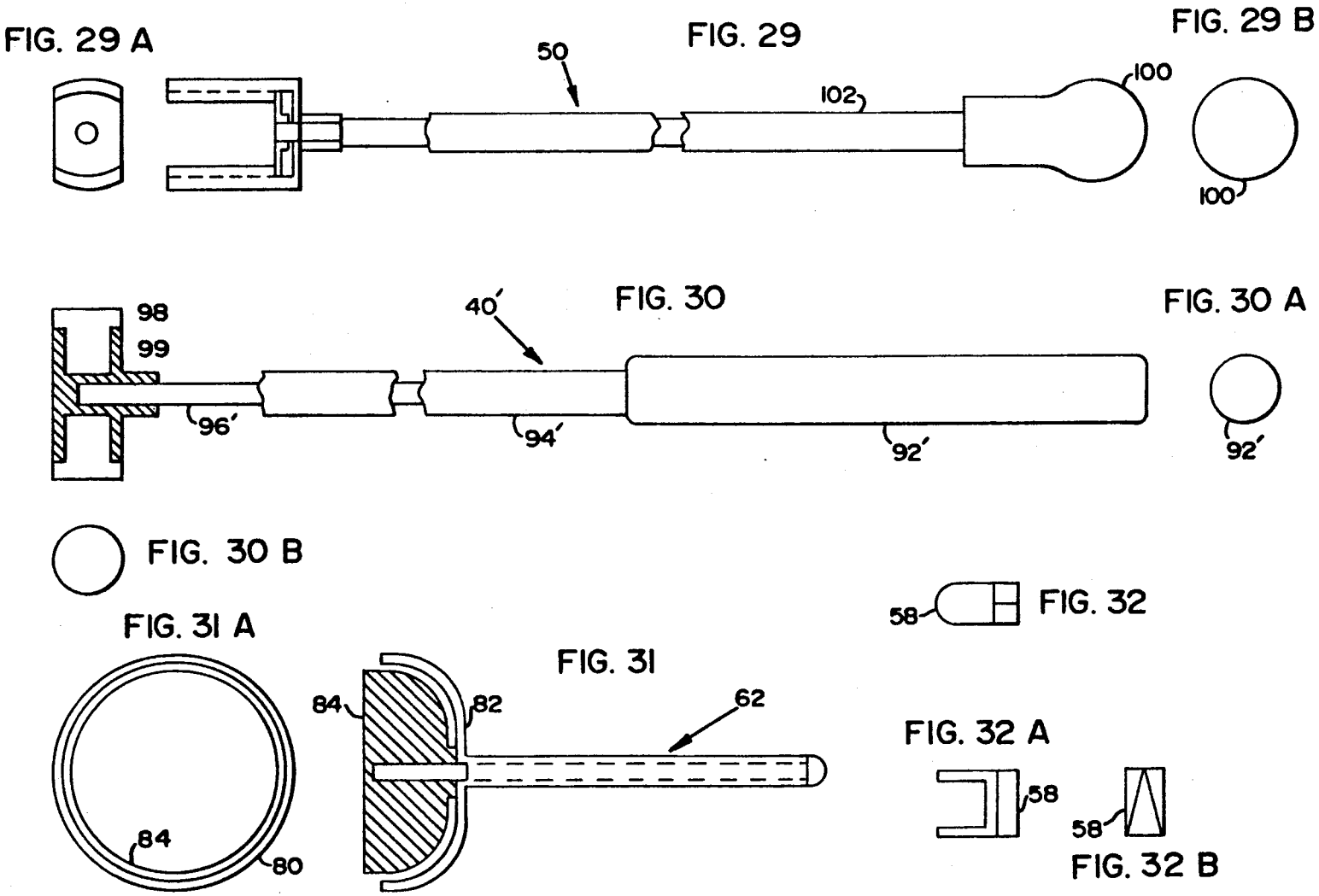
FIG. 29 is a side view of the ball retainer of the invention.
FIG. 30 is a side view of a mallet according to the invention.
FIG. 30A is a partial top view thereof.
FIG. 30B is a partial side view thereof.
FIG. 31 is a partial cross-sectional side view of an end stake according to the invention.
FIG. 31A is a bottom view thereof.
FIG. 32 is an end view of a passage marker according to the invention.
FIG. 32A is a side view thereof.
FIG. 32B is a top view thereof.

FIGS. 28 and 29 illustrate preferred dimensions for the various elements of my croquet set. The wicket assembly, preferably, being 12" long and 6"⅜" at its widest. The wickets being provided with 1½" openings, three-eighths of an inch wide.

FIG. 29 indicates the dimensions of other elements of my set, such as the telescoping ball retainer which telescopes from 14 to 24 inches as does the croquet mallet. The croquet mallet head being provided with 11/16ths diameter end face, the legs of the ball retainer being 1¼" long and 1¼" in overall width, the bell portion of the stake is ⅞ths of an inch in height and 2 inches in diameter; and the whole stake approximately 5 inches long to top to bottom.

It will be understood that the number of balls, mallets, ball retainers, and markers can be of any number so long as they are appropriately color coded.

It will be seen how I provided a croquet set having a unitary wicket assembly and a number of individually visually identifiable direction markers for mounting on each wicket to show the direction of passage and the next wicket to be passed through. I have also provided a stake providing a plurality of marker receiving means, at least, equal to the number of markers, and a bell on the stake for indicating contact therewith.

I have also provided a wicket assembly wherein each wicket may have a recess therein for indicating passage of a ball therethrough by engaging a mallet head adapted to fit end to end into the recess. I have further provided a ball retainer for croqueting an opponent's ball which by operation of its handle, and engage and lift a ball from the playing surface to move it adjacent another player's for croqueting that ball.

It will thus be seen that the object set forth above among those made apparent from the preceding description are efficiently attained and said certain changes may be made in the above constructions without departing from the scope of the invention. It is intended that all matter contained in the above description or shown in the accompanying drawings shall be interpreted as illustrative and not in limiting sense.

It is also to be understood that the following claims are intended to cover all the generic and specific features of the invention herein described, and all statements of the scope of the invention which, as a matter of language, might be said to fall therebetween.

Having described my invention, what I claim as new and desirous cured by Letters Patent is:

1. In a croquet set comprising at least two distinctly visually coded mallets, each having a head, and corresponding coded balls each bearing the same code as a corresponding mallet, the improvement comprising:

A. a plurality of wickets assembled into a unitary structure, each of said wickets having at least two marker receiving means for receiving direction markers, at least two correspondingly coded direction markers each bearing the same code as a corresponding mallet, said markers each adapted to engage said marker receiving means in two positions so as to indicate passage through a wicket of the correspondingly coded ball in either of two directions, and;

B. at least two correspondingly coded ball retainers each bearing the same code as a corresponding mallet, said ball retainers comprising a handle having an elongated axis and having a head at one end thereof, said head comprising spaced members for fitting over and loosely confining one of said balls and having opposed openings on opposite sides of said head of a size smaller than said ball so as to permit a confined ball to make contact with another croquet ball and to permit the confined ball to be struck by said mallet and said spaced members having means operated by said handle to cause said spaced members to hold a confined ball and to permit it to be lifted from a playing surface.

2. A croquet set as defined in claim 1, wherein at least one of said wickets is recessed to form a mallet stop to allow a said mallet head to fit into said recess against said stop.

3. The croquet set defined in claim 2 wherein all of said wickets are tapered and said assembly is formed by die casting.

4. The croquet set defined in claim 1 wherein all of said wickets are tapered and said assembly is formed by die casting.

5. A wicket assembly for a croquet set having at least two distinctly visually coded balls comprising:

A. a plurality of wickets assembled into a unitary structure, each of said wickets having a plurality of marker receiving means each for receiving a direction market in either of two positions; and B. a number of distinctly visually coded direction markers each having the same code as one of said balls and said members being at least equal in number to the number of said plurality of marker receiving means and said markers each adapted to engage said marker receiving means in either of said two positions so as to indicate the intended passage of the correspondingly coded ball through a wicket in one of two opposite directions.

6. The wicket assembly as defined in claim 5; and:

C. at least one peg comprising a base and a plurality of marker receiving means attached to said peg above said base, and said marker receiving means being at least equal in number to the number of said markers.

7. The wicket assembly defined in claim 6 and a bell at the base of said peg beneath said marker receiving means and adapted to ring when struck by a croquet ball.

8. A wicket assembly as defined in claim 5 and four field markers for defining a four-sided field about said wicket assembly.

9. A wicket assembly as defined in claim 5 and adjusting means for narrowing the width of the openings through said wickets.

10. The wicket assembly defined in claim 9 wherein said wickets comprise two vertical legs and an upper horizontal cross member between said legs and said adjusting means comprises:

vertically disposed pin receiving means in said cross member; and elongated pins fitting within said vertically disposed receiving means between said legs.

11. The wicket assembly defined in claim 5 wherein said markers comprise:

a pair of depending legs supporting a horizontally disposed colored triangle.

12. The wicket assembly defined in claim 11 wherein said wickets comprise vertically disposed leg receiving means, said depending legs of said markers being adapted to fit into said leg receiving means.

13. The wicket assembly defined in claim 5, and at least two distinctly visually coded mallets and corresponding visually coded balls and at least two said direction markers also correspondingly visually coded.

14. The wicket assembly defined in claim 5 and pins depending from said wicket assembly for engaging a support surface.

15. The croquet set defined in claim 1 wherein said spaced members are movable into an out of frictional engagement with one of said croquet balls by operation of said handle.

16. The croquet set defined in claim 15 wherein said handle is operated by rotation thereof.

17. The croquet set defined in claim 1 wherein said spaced members are adapted to be spread apart by cam means operated by rotation of said handle.

18. The croquet set defined in claim 17 wherein said spaced members comprise pins for engaging a playing surface to prevent rotation thereof while said handle is rotated.

19. The croquet set defined in claim 17 wherein said ball retainer further comprises signal means for indicating whether said spaced members are spread apart.

20. The croquet set defined in claim 5 wherein all of said wickets are tapered and said assembly is formed by die casting.

* * * * *